United States Patent [19]

Badger

[11] Patent Number: 4,580,338

[45] Date of Patent: Apr. 8, 1986

[54] APPARATUS FOR POSITIONING ELECTRICAL INSULATORS IN MAKING A RAILWAY RAIL-AND-FASTENING ASSEMBLY

[75] Inventor: Peter Badger, Sheffield, England

[73] Assignee: Pandrol Limited, London, England

[21] Appl. No.: 502,487

[22] Filed: Jun. 9, 1983

[30] Foreign Application Priority Data

Jun. 10, 1982 [GB] United Kingdom ..... 8216851

[51] Int. Cl.[4] ..... B23P 19/04

[52] U.S. Cl. ..... 29/759; 238/249

[58] Field of Search ..... 29/235, 759, 729; 238/349

[56] References Cited

FOREIGN PATENT DOCUMENTS 197808 8/1978 United Kingdom ..... 238/349

1540868 2/1979 United Kingdom .

*Primary Examiner*—Howard N. Goldberg

*Assistant Examiner*—Timothy V. Eley

*Attorney, Agent, or Firm*—Norbert P. Holler

[57] ABSTRACT

To position an electrical insulator, having first and second ends at which are first and second sideways-projecting lugs, so that a part of the insulator lies on the upper face of a rail flange, another part of the insulator lies between the rail flange and a neighboring upward projection, and the upward projection lies partly between the lugs, the insulator is held in an inclined position by gripping its upper end between two clamping parts and moved with a component of motion parallel to the rail until the lower lug catches on the upward projection. Continued movement of the clamping parts cannot be followed by the insulator, which changes its orientation and prises the clamping parts apart. They release it and the higher end of the insulator descends, possibly as a consequence of force exerted on it by a clip. The clamping parts may be mounted on a magazine containing rail clips.

2 Claims, 7 Drawing Figures

Figure 1:
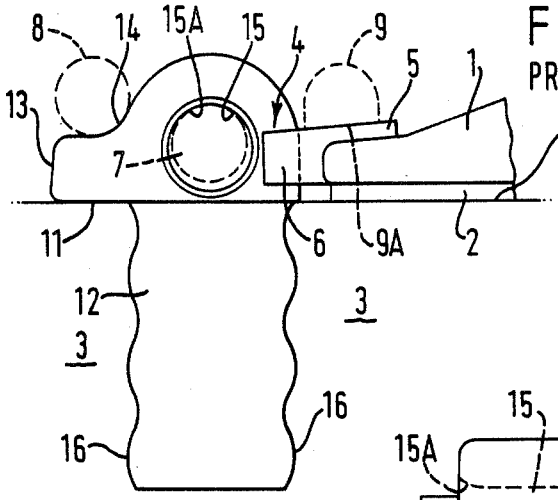
FIG. 1. PRIOR ART

APPARATUS FOR POSITIONING ELECTRICAL INSULATORS IN MAKING A RAILWAY RAIL-AND-FASTENING ASSEMBLY

The invention relates to a method of positioning, and an apparatus for positioning, an electrical insulator, having first and second ends, on a sub-assembly, in the process of making a railway rail-and-fastening assembly, the sub-assembly comprising a rail foundation, an upward projection on the rail foundation and a railway rail having a flange at its foot standing on the foundation with all outer edge of the rail flange facing and separated by a space from the upward projection, and the insulator comprising a first, elongate, plate-like, portion for placement of the upper face of the rail flange, a second portion depending from the first portion for placement in said space, and first and second sideways-projecting lugs at the first and second ends, respectively, of the insulator for placement with part of the upward projection between them, whereby movement of the insulator along the rail is limited.

According to a first aspect of the present invention, the method comprises holding the first end of the insulator by using a first clamping part and using a second clamping part to press the insulator against the first clamping part, the insulator being inclined to the horizontal such that its first end is higher than its second end, and causing the clamping parts to move with a component of motion in one direction parallel to the rail, the clamping parts carrying the insulator along with them until the second lug presses on one side of said upward projection and the insulator then being unable to follow the continued movement of the clamping parts, which are then prised apart by the insulator being forced by the clamping parts to change its orientation, the clamping parts finally releasing the insulator so that its first end can descend until the first lug is on that side of said upward projection which is opposite said one side.

According to a second aspect of the invention, the method comprises moving the insulator with a component of motion in one direction parallel to the rail and later holding the first end of the insulator by using a first clamping part and using a second clamping part to press the insulator against the first clamping part, the insulator being inclined to the horizontal such that its first end is higher than its second end, and causing the clamping parts to move with a component of motion in the direction opposite to said one direction parallel to the rail, the clamping parts carrying the insulator along with them until the second lug presses on one side of said upward projection and the insulator then being unable to follow the continued movement of the clamping parts, which are then prised apart by the insulator being forced by the clamping parts to change its orientation, the clamping parts finally releasing the insulator so that its first end can descend until the first lug is on that side of said upward projection which is opposite said one side.

According to a third aspect of the invention, the method comprises supporting the insulator so that it is inclined to the horizontal and its first end is higher than its second end, its second lug being in contact with one side of said upward projection, and then driving a railway rail-fastening clip so that a substantially straight leg thereof enters a passageway in said upward projection and a further portion of the clip bears upon the first portion of the insulator and causes the first end to descend until the first lug is substantially at the same level as the second lug and is on the opposite side of said upward projection.

According to a fourth aspect of the invention, the apparatus comprises a magazine containing railway rail-fastening clips, a first clamping member pivotally mounted on the magazine and having a clamping part inclined to the horizontal, a second clamping member pivotally mounted with respect to the first clamping member and resiliently biased so that any movement of a clamping part thereof away from the clamping part of the first clamping member is opposed, whereby one end of the first portion of the insulator may be gripped between the clamping parts whilst the other end of the first portion is at a lower level and the insulator is inclined to the horizontal.

A holding means comprising the first and second clamping parts may be part of a holder which carries a row of the insulators end to end which move towards the holding means or the holding means may be part of a holder which carries a stack of the insulators one on top of the other which are fed in turn to the holding means. Instead, the insulators may be fed to the holding means from a magazine in which the insulators are stacked vertically, the insulators leaving the magazine via a slideway transfer track which leads to an insulator transfer jaw, which transfers individual insulators to the holding means. In any of these cases, a mechanism can be provided which has a part that turns to make the holding means move forwardly and downwardly to feed the second end of the insulator substantially into its operative position and then to make the holding means move backwards and upwardly, the second lug catching on the upward projection.

The apparatus may comprise two holding means for placing insulators simultaneously on opposite flanges of a railway rail. Instead, the apparatus can comprise four such holding means for placing insulators simultaneously on opposite flanges of two rails of a railway track.

The holding means, or each holding means if there are two holdings means, can comprise a first clamping part having a lower surface against which an upper surface of a flange of the insulator can be pressed and a second clamping part pivoted on the first clamping part and resiliently biased to a position where it traps, by pressing on the lower surface of the flange of the insulator, the flange of the insulator between itself and the lower surface of the first clamping part.

For a better understanding of the invention and to show how the same may be carried into effect, reference will now be made, by way of example, to the accompanying drawings, in which:-

Figure 2:
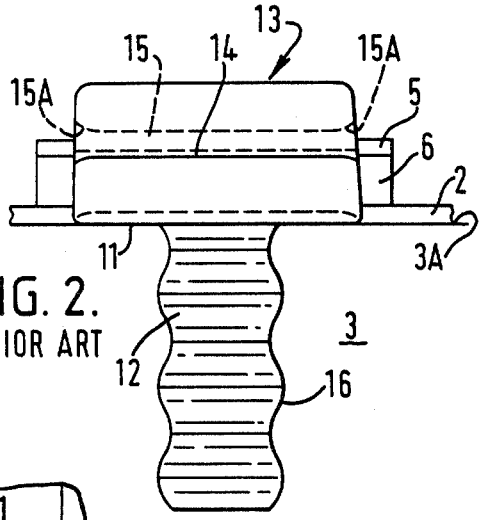
FIG. 2. PRIOR ART
Figure 3:
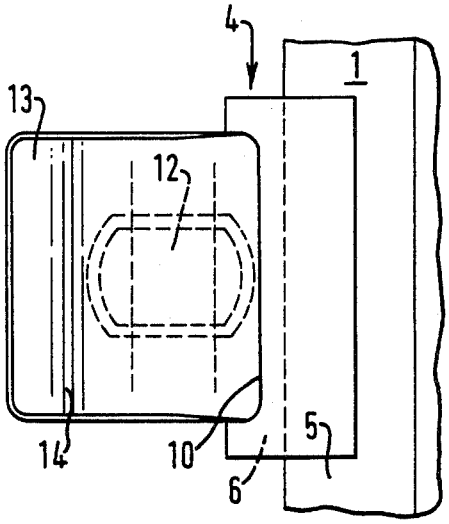
FIG. 3. PRIOR ART
Figure 5:
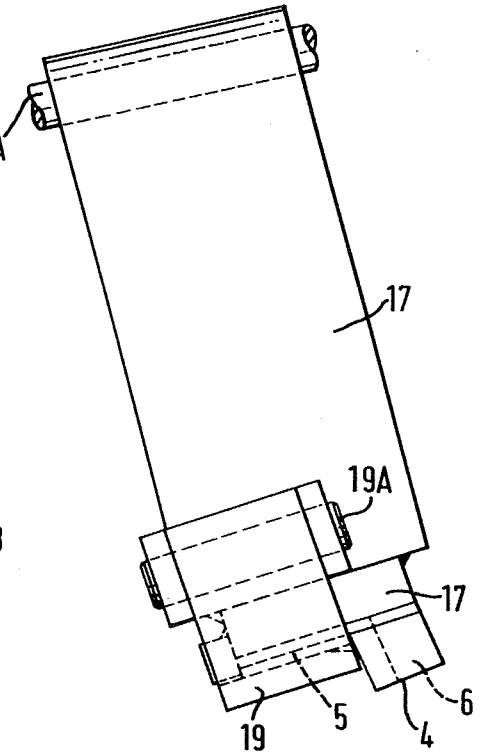
Figure 4:
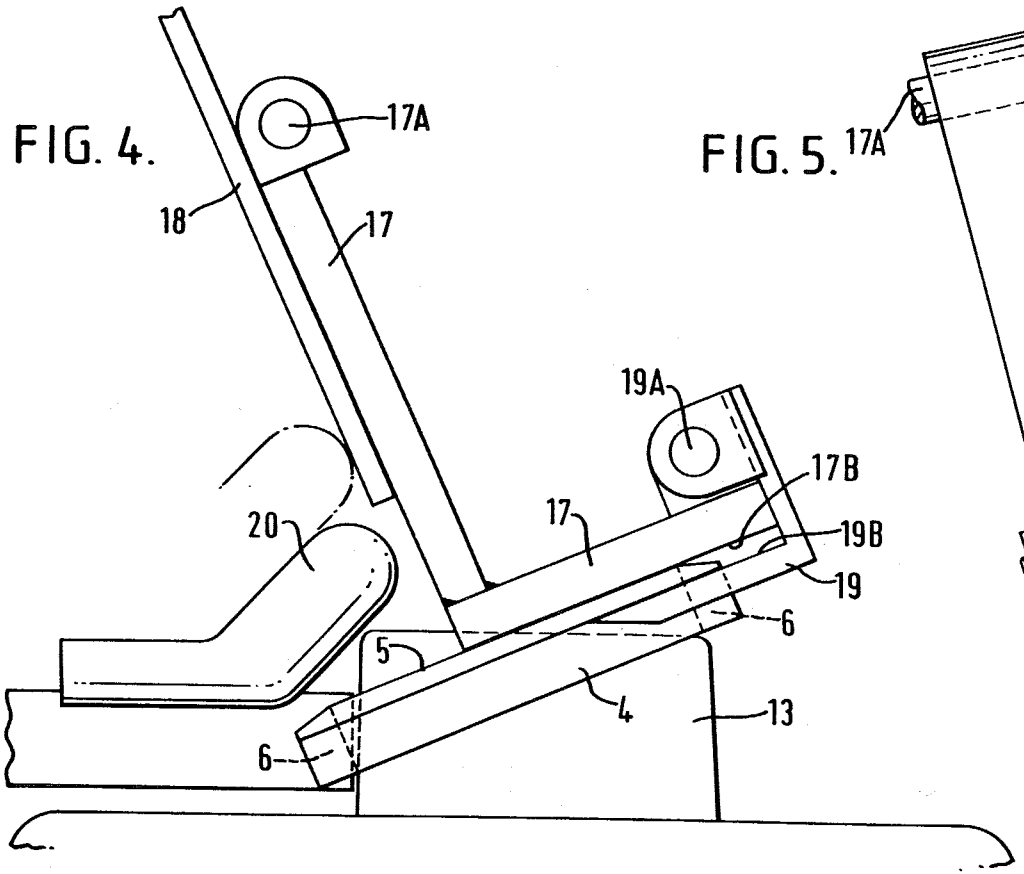
Figure 6:
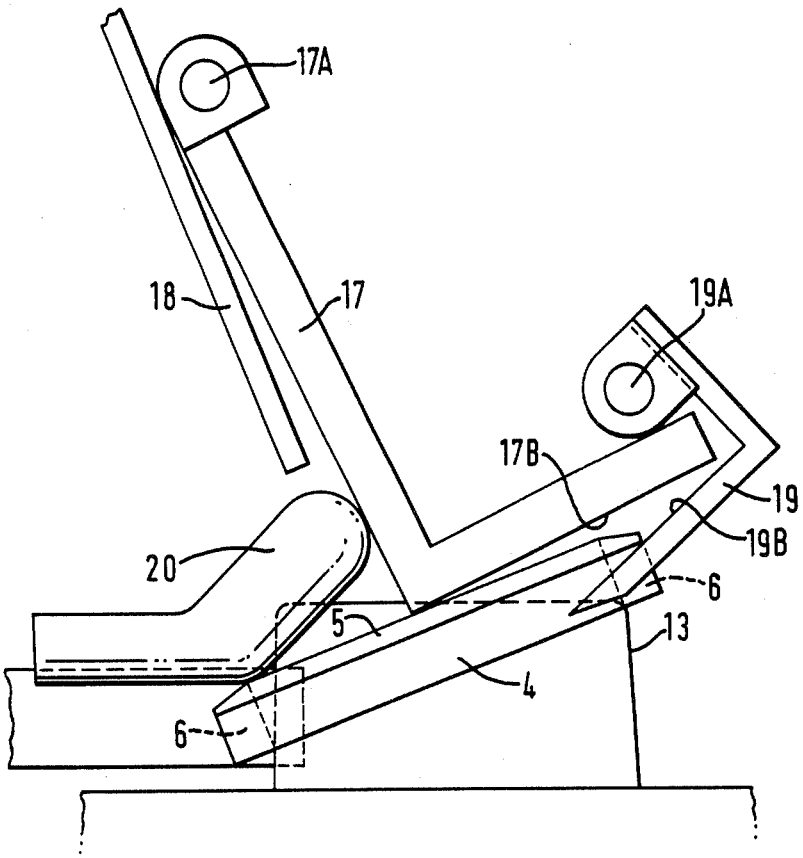
Figure 7:
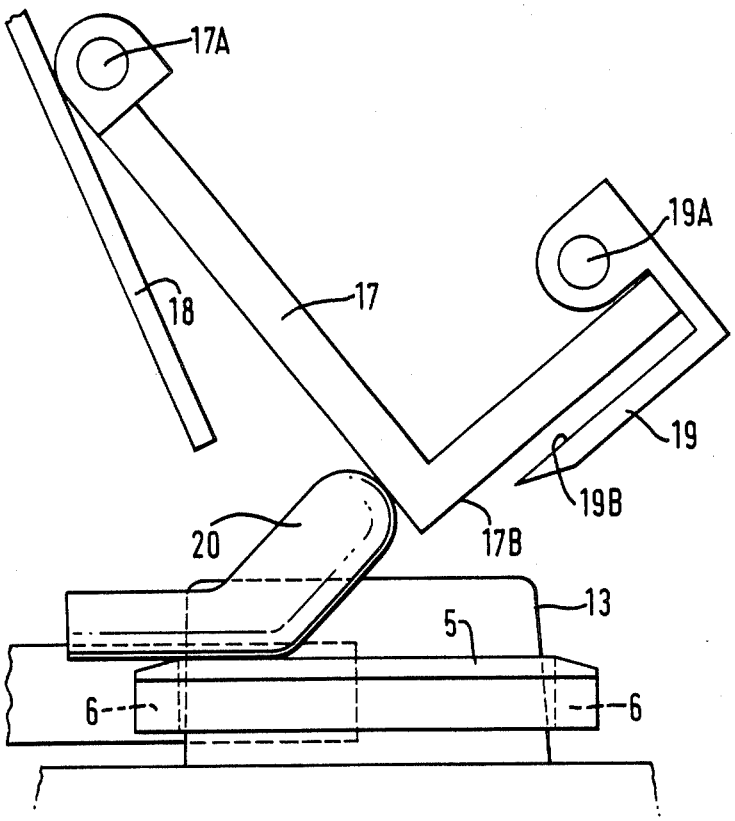

FIG. 1 shows an end view of a known rail-and-fastening assembly in a railway track, FIG. 2 is a front view of the assembly shown in FIG. 1, with parts omitted for clarity, FIG. 3 is a plan view of the assembly shown in FIG. 1, with parts omitted for clarity, FIG. 4 shows a view of part of the apparatus according to the invention, taken from the opposite side to that shown in FIG. 2, the apparatus being shown in an initial operative position, FIG. 5 is an end view of the apparatus shown in FIG. 4, FIG. 6 is a view similar to FIG. 4 showing a second operative position of the apparatus with the insulator being placed on the flange of a railway rail, and FIG. 7 is a view similar to FIG. 4 showing a third operative position of the apparatus with the insulator placed on the flange of the rail.

FIGS. 1 to 3 show an anchoring member made of malleable cast iron and having an upper part 13 lying above the upper surface 3A of a rail foundation in the form of a concrete railway sleeper 3 and a lower part 12, having protruberances 16, which was incorporated in the concrete when the sleeper was cast in a mould. The anchoring member provides an upward projection on the rail foundation and this upward projection has in it a passageway 15, having a flared mouth 15A, which receives a part 7 of a clip for holding down a railway rail, the part 7 being a substantially straight leg of the clip.

The railway rail, the length of which is parallel to the passageway 15 and the part 7 of the clip, has at its foot a flange 1 the edge of which faces, and is separated by a space from, the anchoring member. The rail also has a web (not shown). The flange is separated from the sleeper by a rubber pad 2 and from the anchoring member by a vertical limb of an elongate nylon insulator 4 of substantially L-shaped cross-section having a sideways-projecting lug 6 at each end and an elongate plate-like portion 5, lying on the upper face of the flange 1 of the rail, from which the vertical limb of the insulator depends. A flat surface 9A at the bottom of a part 9 of the clip bears on the portion 5 of the insulator and a part 8 of the clip bears on a part 14 of the anchoring member. The sleeper 3, the pad 2, the anchoring member and the rail form the sub-assembly referred to above.

The invention is concerned with placing the insulator in the illustrated position, in which part of the upward projection afforded by the anchoring member lies between the lugs 2, whereby movement of the insulator along the rail is limited.

FIGS. 4 to 7 show the apparatus according to the invention, FIGS. 4, 6 and 7 viewing the apparatus from the web of the rail towards the upper part 13 of the anchoring member, which part 13 forms the upward projection.

The holding means comprises an L-shaped clamping member 17 which is pivoted at 17A to a magazine 18 (shown diagrammatically) for stacking clips which are to hold the railway rail down. A second clamping member 19 forming a latch member is pivotally mounted at 19A to the clamping member 17, a resilient bias being provided to cause the clamping member 19 normally to pivot to the position shown in FIGS. 4 and 7 where a portion of it abuts against an edge of the clamping member 17.

The clamping members 17 and 19 have clamping parts which have surfaces 17B and 19B. About a third of the length of the portion 5 of the insulator can be trapped between the surfaces 17B and 19B thereby to hold the insulator once it has been fed into that position.

The insulators 4 are loaded one at a time into the holding means by means of a transfer jaw (not shown) which is fed from an insulator transfer track leading (to the left, considering FIG. 4) from a magazine holding a supply of the insulators 4. The transfer jaw is in line with, and is able to accept individual insulators 4 from, the transfer track and is moved by a piston-and-cylinder arrangememt to and from the holding means of the invention to transfer the insulators thereto. A length of brush strip is fastened to the transfer jaw to assist in holding an insulator in the jaw.

FIGS. 4, 6 and 7 illustrate three stages in the placing of the insulator 4 on the flange 1 of the railway rail. FIG. 4 shows the condition where the insulator 4 has been fed to the holding means and the holding means has moved with a component of motion in one direction (to the left) parallel to the rail so that the insulator 4 has moved with a component of motion in said one direction and one of the lugs 6 on the insulator 4 has descended and then the holding means has moved with a component of motion parallel to the rail to the right, whereupon the lug 6 has been caused to press against one side of the upper part 13 of the anchoring member. FIG. 4 also shows part of the clip (reference 20) described above for holding the railway rail down, the clip being ready to be pushed onto, inter alia, the insulator 4.

FIG. 6 shows what happens when the holding means is then moved further with a component of motion to the right parallel to the rail. Because one of the lugs 6 has caught on one side of the anchoring member, the insulator 4 is no longer being carried by the clamping parts, the insulator being now unable to follow the return movement of the holding means so that, as the holding means is moved to the right, the clamping members are prised apart by virtue of the fact that the insulator is forced by the clamping parts to change its orientation. Thus the part 19 is caused to pivot about the pivot 19A against its resilient bias. Eventually the holding means is caused to release the insulator 4 so that its higher lug can descend into its operative position. Then the two lugs are at substantially the same level as one another.

This movement is assisted by the rail clip being driven parallel to the rail so that the part 9 of the rail clip runs along the upper face of the portion 5 of the insulator, forcing it down on to the rail flange. Another part of the clip pushes the part 17 to pivot it about the pivot 17A. This combined movement serves to force the insulator 4 into position on the flange of the railway rail whilst causing it to be released from the holding means.

FIG. 7 shows the situation where the insulator 4 has been released from the holding means and the rail clip has been driven sufficiently far onto the insulator 4 to hold it down on the flange of the rail whilst at the same time it has moved the holding means clear so that the resilient bias on the part 19 has caused it to return to its initial position. The clip 20 is then driven home and the holding means is lifted clear of the clip and is positioned ready to receive another insulator 4.

I claim:

1. Apparatus for positioning an electrical insulator, having first and second ends, on a sub-assembly, in the process of making a railway rail-and-fastening assembly, the sub-assembly comprising a rail foundation, an upward projection on the rail foundation, a railway rail having a flange at its foot standing on the foundation with an outer edge of the rail flange facing and separated by a space from the upward projection, and the insulator comprising a first, elongate, plate-like, portion for placement on the upper face of the rail flange, a second portion depending from the first portion for placement in said space, and first and second lugs at the first and second ends, respectively, of the insulator for placement with part of the upward projection between them, whereby movement of the insulator along the rail is limited, the apparatus comprising a magazine containing railway rail-fastening clips, a first clamping member pivotally mounted on the magazine and having a clamping part inclined to the horizontal, and a second clamping member pivotally mounted with respect to the first clamping member and resiliently biased so that any movement of a clamping part thereof away from the clamping part of the first clamping member is opposed, whereby one end of the first portion of the insulator may be gripped between the clamping parts whilst the other end of the first portion is at a lower level and the insulator is inclined to the horizontal.

2. Apparatus for positioning an electrical insulator, having first and second ends, on a sub-assembly, in the process of making a railway rail-and-fastening assembly, the sub-assembly comprising a rail foundation, an upward projection on the rail foundation, a railway rail having a flange at its foot standing on the foundation with an outer edge of the rail flange facing and separated by a space from the upward projection, and the insulator comprising a first, elongate, plate-like, portion for placement on the upper face of the rail flange, a second portion depending from the first portion for placement in said space, and first and second lugs at the first and second ends, respectively, of the insulator for placement with part of the upward projection between them, whereby movement of the insulator along the rail is limited, the apparatus comprising a support structure, a first clamping member pivotally mounted on the support structure and having a clamping part for engaging the insulator, a second clamping member pivotally mounted with respect to the first clamping member and having a clamping part for engaging the insulator, the second clamping member being resiliently biased so that any movement of the clamping part thereof away from the clamping part of the first clamping member is opposed, whereby the insulator can be gripped at its first end between said clamping parts whilst the second end of the insulator is at a lower level than the first end of the insulator and the insulator is inclined to the horizontal, so that upon the clamping members being moved with a component of motion in one direction parallel to the rail, the clamping parts carry the insulator along with them until the second lug presses on one side of said upward projection and the insulator then is unable to follow the continued movement of the clamping parts, which are then prised apart by the insulator being forced by the clamping parts to change its orientation, the clamping parts finally releasing the insulator so that its first end can descend until the first lug is on that side of said upward projection which is opposite said one side.

* * * * *